US007866362B2

(12) United States Patent
Kai et al.

(10) Patent No.: US 7,866,362 B2
(45) Date of Patent: Jan. 11, 2011

(54) TRANSFER TOOL

(75) Inventors: Keiji Kai, Osaka (JP); Hideto Shima, Kyoto (JP)

(73) Assignee: Kokuyo S&T Co., Ltd., Osaka (JP)

( * ) Notice: Subject to any disclaimer, the term of this patent is extended or adjusted under 35 U.S.C. 154(b) by 356 days.

(21) Appl. No.: 11/385,906

(22) Filed: Mar. 22, 2006

(65) Prior Publication Data

US 2007/0009307 A1 Jan. 11, 2007

(30) Foreign Application Priority Data

Jun. 23, 2005 (JP) ..... P2005-182827

(51) Int. Cl.
*B32B 15/00* (2006.01)

(52) U.S. Cl. ..... 156/540; 156/541; 156/557; 156/577

(58) Field of Classification Search ..... None
See application file for complete search history.

(56) References Cited

U.S. PATENT DOCUMENTS

| | | | | |
|---|---|---|---|---|
| 4,849,064 | A * | 7/1989 | Manusch et al. | 156/577 |
| 5,430,904 | A * | 7/1995 | Ono et al. | 15/104.94 |
| 5,685,944 | A * | 11/1997 | Nose et al. | 156/540 |
| 5,770,007 | A * | 6/1998 | Czech et al. | 156/540 |
| 5,897,742 | A * | 4/1999 | Semmler | 156/577 |
| 6,325,130 | B1 * | 12/2001 | Kageyama et al. | 156/577 |
| 6,418,997 | B1 * | 7/2002 | Tamai et al. | 156/577 |
| 6,554,045 | B1 * | 4/2003 | Lee | 156/577 |
| 6,776,209 | B1 | 8/2004 | You | |
| 6,808,565 | B1 * | 10/2004 | Koyama et al. | 118/200 |
| 7,357,167 | B2 * | 4/2008 | Mitsui et al. | 156/523 |
| 2002/0153106 | A1 * | 10/2002 | Huthmacher | 156/577 |
| 2003/0047286 | A1 * | 3/2003 | Narita | 156/577 |

FOREIGN PATENT DOCUMENTS

| | | |
|---|---|---|
| EP | 1285874 | 2/2003 |
| JP | 11059076 | 3/1999 |
| JP | 2002-178694 | 6/2002 |
| JP | 2004114471 | 4/2004 |

* cited by examiner

*Primary Examiner*—Philip C Tucker
*Assistant Examiner*—Kimberly K McClelland
(74) *Attorney, Agent, or Firm*—Banner & Witcoff, Ltd.

(57) ABSTRACT

The invention provides a transfer tool which can preferably maintain a shape while improving a strength at a time of using, and has an improved usability. The transfer tool is provided with a first case (1) holding a replacement part including at least a transferring object, a second case (2) detachably engaged with the first case (1) and holding a non-replacement part constituting at least a part of a feeding mechanism part feeding the transferring object to a transferred object, a holding portion (3) outside fitted detachably to a predetermined region of the first case (1) and the second case (2) and capable of holding the first case (1) and the second case (2), and an engagement portion (X) detachably engaging the first case (1) and the second case (2) in a opposite direction of the holding portion (3).

7 Claims, 5 Drawing Sheets

TRANSFER TOOL

BACKGROUND OF THE INVENTION

1. Field of the Invention

The present invention relates to a refilling type transfer tool used for transferring a transferring object such as a tape glue, a correction tape or the like to a transferred object such as a paper or the like.

2. Description of the Related Art

As this king of refill type transfer tool, there have been considered various structures in which a case having a half dividing structure has a transferring object and a feeding mechanism part for feeding the transferring object out of the case built-in, and a member to be replaced is counterchanged by a new one by separating the case in the case that the transfer tool is finished (for example, refer to Japanese Unexamined Patent Publication No. 2002-178694). The transfer tool disclosed in the publication is structured such that a case is formed by a half dividing structure (in which one is called a first case and the other is called a second case tentatively), the first case has a coating tape, a reel and a transfer head built-in, the second case has mechanical parts such as gears or the like built-in, the transfer tool can be set to a usable state by engaging an engagement hook and a locking portion at a desired position in a state of fitting the first case and the second case so as to assemble as an integral case, and a cartridge can be replaced by a new one by regarding the first case having the coating tape or the like built-in as the cartridge.

In the transfer tool having the structure mentioned above, since the case has the half fitting casing structure constituted by the first case and the second case, in the case that a force applying the transfer head to the transferred object such as the paper or the like at a time of using is too strong, or in the case that a force of a user holding the case at a time of using is too strong, a deflection is generated in the case itself, and an unnecessary pressing force is applied to the parts within the case, whereby it is impossible to suitably deliver the transferring object, so that there is a case that a transferring performance is deteriorated. Further, since the structure is made such that the engagement hook and the locking portion are engaged in the state in which the first case and the second case are fitted to each other, it is hard to assemble the integral case until the first case and the second case which are temporarily separated are accurately positioned, and a labor hour for positioning is troublesome.

SUMMARY OF THE INVENTION

Accordingly, the present invention is made by taking the problem mentioned above into consideration, and an object of the present invention is to provide a transfer tool which can preferably maintain a shape while improving a strength at a time of using, and has an improved usability.

In order to achieve the object mentioned above, the present invention employs the following means. In other words, in accordance with the present invention, there is provided a transfer tool comprising: a first case holding a replacement part including at least a transferring object; and a second case detachably engaged with the first case and holding a non-replacement part constituting at least a part of a feeding mechanism part feeding the transferring object to a transferred object, wherein the transfer tool comprises: a holding portion outside fitted detachably to a predetermined region of the first case and the second case and capable of holding the first case and the second case; and an engagement portion detachably engaging the first case and the second case in a opposite direction of the holding portion.

In this case, the holding portion may be structured such as to be attached to any one of the first case and the second case, or may be structured as an independent body.

In accordance with the structure mentioned above, since the holding portion securely holds the first case and the second case in the predetermined region, that is, in one side corresponding to the opposite direction of the engagement portion, it is possible to securely hold the shape of the transfer tool itself so as to improve a using feeling of the transfer tool, and it is possible to preferably maintain a strength of the transfer tool.

In order to more securely make the strength and the engagement holding compatible, it is desirable to arrange the engagement portion provided at a position which is approximately facing accurately to the holding portion. Further, as a simple structure which can obtain the effect mentioned above, there can be listed up a structure in which the engagement portion is provided at only one position opposite to the holding portion.

In order to preferably cancel the engagement between the first case and the second case so as to replace the replacement part without interference between the replacement part and the non-replacement part, the structure is desirably made such that the first case and the second case can be attached and detached by relatively rotating the first case and the second case around the engagement portion in an attitude in which the holding portion is cancelled from the first case and the second case, and a taper surface avoiding the interference between the replacement part and the non-replacement part at a time of a rotating motion is provided in any one or both of the replacement part and the non-replacement part.

In order to effectively reduce the number of the parts of the first case including the replacement part so as to reduce a running cost, it is desirable to attach the holding portion to the second case to which the non-replacement part is attached.

In accordance with the present invention, since the holding portion securely holds the first case and the second case in the predetermined region, that is, the one side corresponding to the opposite direction of the engagement portion, it is possible to securely hold the shape of the transfer tool itself so as to increase the using feeling and improve the using feeling, whereby it is possible to provide the transfer tool preferably maintaining the strength.

BEST MODE FOR CARRYING OUT THE INVENTION

A description will be given below of an embodiment in accordance with the present invention with reference to the accompanying drawings.

Figure 1:
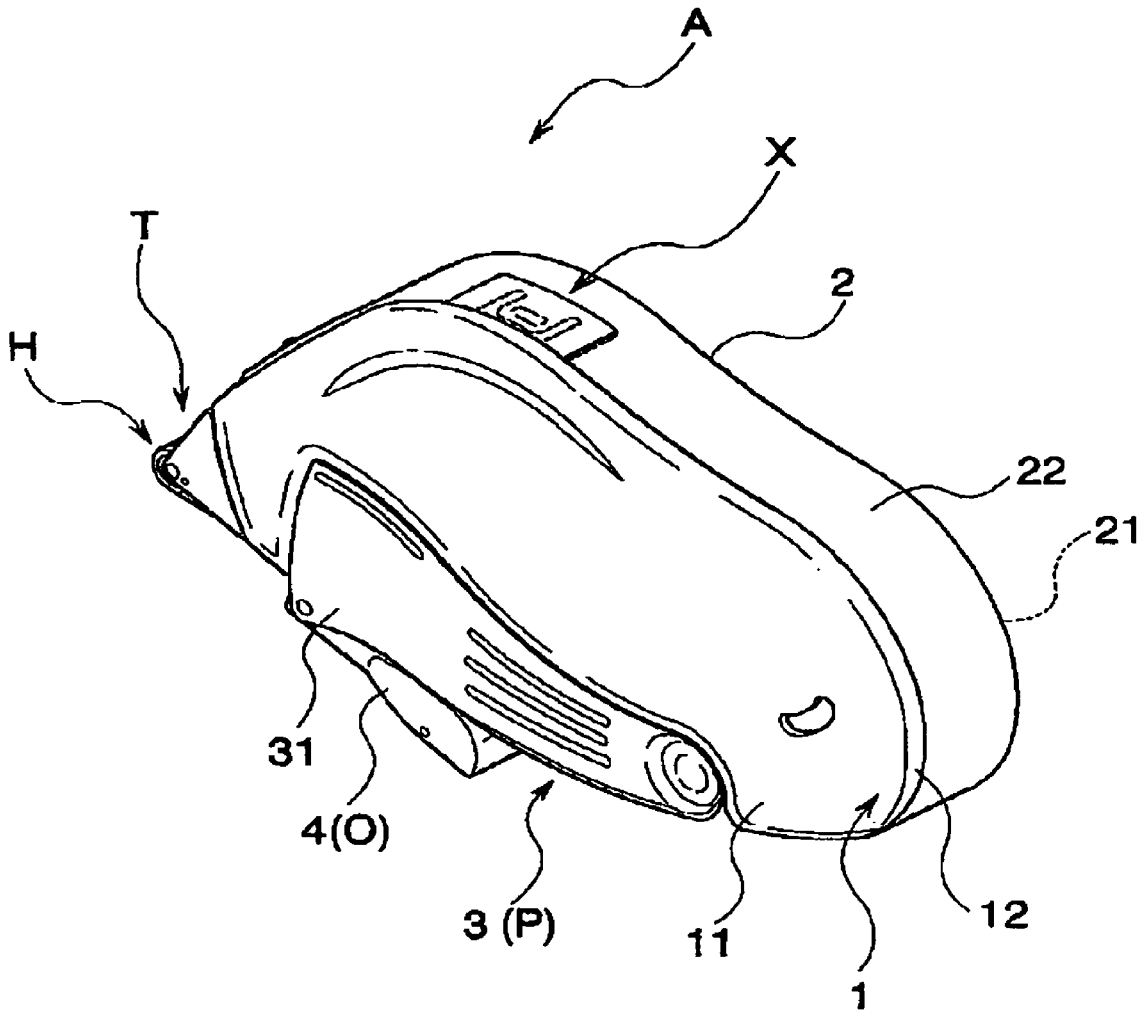
FIG. 1 is a perspective view showing a transfer tool in accordance with an embodiment of the present invention.

A transfer tool A in accordance with the embodiment a perspective view of which is shown in FIG. 1 employs a coating tape-shaped glue (hereinafter, refer to as "tape glue T") as a transferring object, and is used by sticking a glue of the tape glue T delivered per a desired length to a surface of a transferred object such as a slip of paper or the like. In this case, the tape glue T is structured by previously sticking the glue onto one surface of a long and thin tape main body made of a resin. In the present embodiment, the transfer tool A has a first case 1 and a second case 2 which accommodate the glue and a feeding mechanism part feeding the glue and are formed approximately as a half dividing structure, and a holding portion 3 which is outside fitted to a pair of cases 1 and 2, as main constituting parts.

In this case, the transfer tool A in accordance with the present embodiment is characterized in that a opposite direction of the holding portion 3 mentioned above is provided with an engagement portion X which detachably engages the first case 1 and the second case 2.

Figure 2:
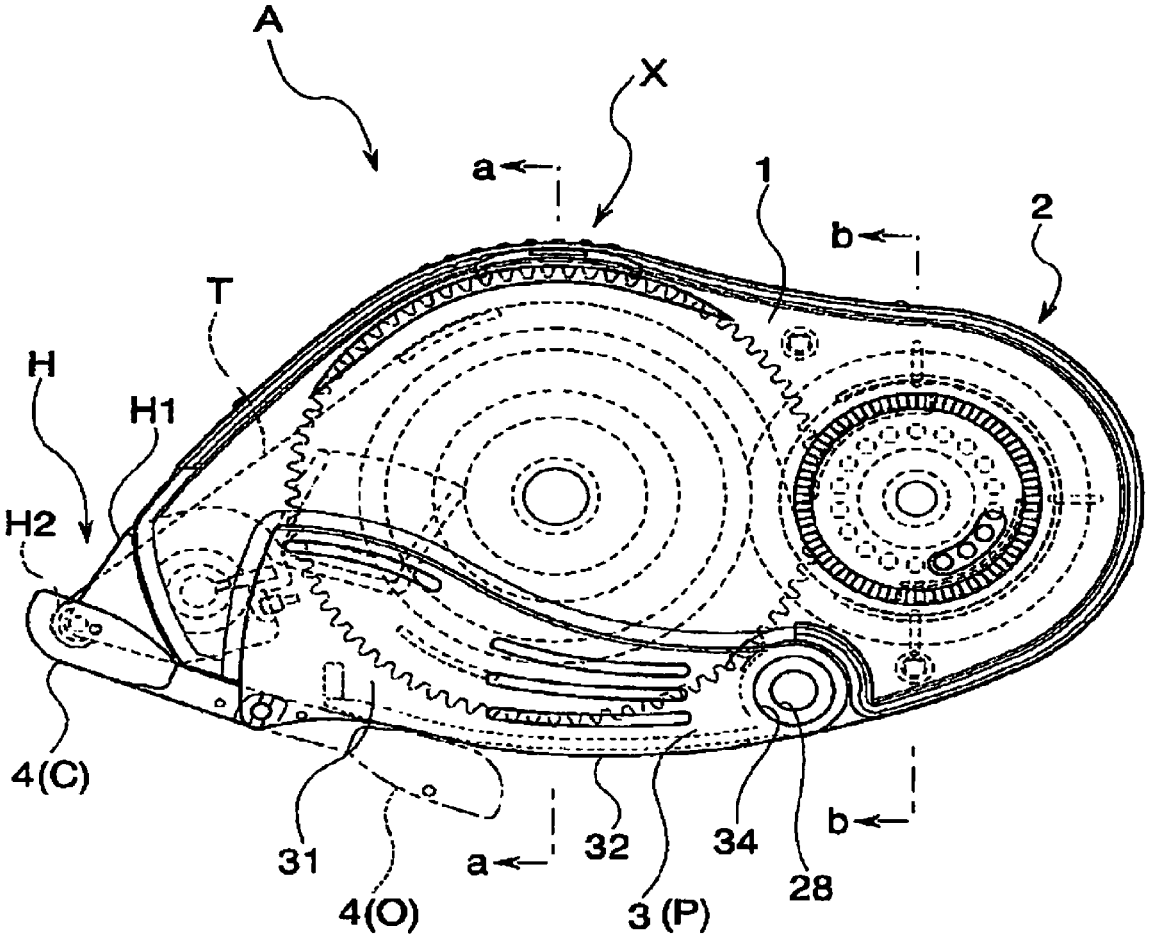
FIG. 2 is a plan view showing a used state of the transfer tool in accordance with the embodiment.

A description will be in detail given below of each of the constituting elements of the transfer tool A with reference to FIGS. 1, 2, 3, 4A and 4B. In this case, FIG. 4A is a cross sectional view along a line a-a in FIG. 2 and FIG. 4B is a cross sectional view along a line b-b in FIG. 2.

The first case 1 functions as a replacement cartridge, and is constituted by a side wall 11 forming an outer wall, and a peripheral wall 12 continuously provided over a front end portion, an upper end portion and a rear end portion of the side wall 11, and a lower end portion side thereof is opened. In the present embodiment, the first case 1 is structured as an integral molded product made of a synthetic resin. Further, in a lower side of the side wall 11, a portion which is brought into contact with the holding portion 3 is structured as a concave portion 13 which is depressed to an inner side in correspondence to a thickness of a vertical wall 31 of the holding portion 3 mentioned below, particularly as shown in FIG. 4A. Further, an engagement hook 14 is formed at one position approximately facing accurately to the holding portion, that is, a opposite position, in an upper end portion of the peripheral wall, and an engagement projection 15 formed in a leading end of the engagement hook 14 can be engaged with an engagement hole 25 mentioned below of the second case 2, whereby an engagement portion X mentioned below can be structured. Further, a shaft portion is formed in a protruding manner in a front end portion side and a rear end portion side in an inner side surface of the side wall 11, a wind-off spool 16 holding the unused tape glue T in a winding state is rotatably supported to a shaft portion of the front end portion side (FIG. 4A), and a take-up spool 17 taking up the tape main body after transferring the glue so as to hold in a take-up manner is supported to a shaft portion of the rear end portion side (FIG. 4B).

Further, a transfer head H is attached to a front end portion of the first case 1 so as to protrude from a lower opening. Specifically, the transfer head H is constituted by a roller receiver H1 attached to a front end portion of the side wall 11, and a transfer roller H2 rotatable with respect to the roller receiver H1. Accordingly, in the taper glue T taken out from the wind-off spool 16, only the glue is applied to the slip of paper or the like from a downward surface via a downward surface of the transfer roller H2 from a lower side, and only the tape main body is recovered in the winding state from a lower side of the take-up spool 17 through an upper side of the wind-off spool 16 from the transfer roller H2. Further, the tape glue T corresponding to a consumable part, the wind-off spool 16 corresponding to a part of the feeding mechanism part for supplying the tape glue T to the slip of paper, the take-up spool 17, the transfer head H and the like are set as replacement parts, and are replaced by new ones in a state of being attached to the first case 1.

Figure 4:
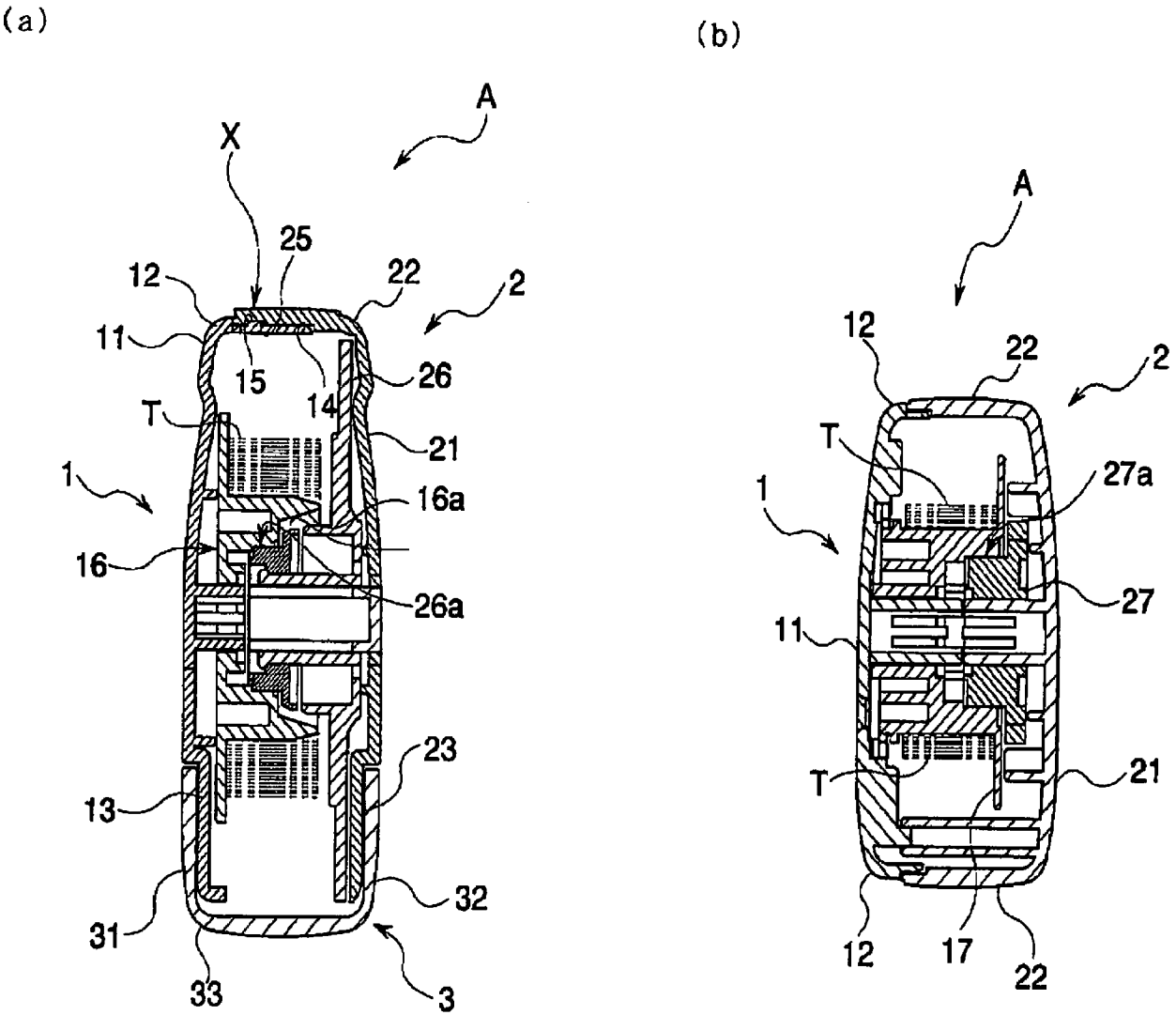
FIGS. 4A and 4B are cross sectional views in accordance with FIG. 2.

The second case 2 holds a non-replacement part corresponding to a part of the feeding mechanism part for supplying the tape glue T to the slip of paper. Specifically, as shown in FIG. 4, the second case 2 is constituted by a side wall 21 which forms a pair together with the side wall 11 of the first case 1 and structures an outer side wall of the transfer tool A, and a peripheral wall 22 which is continuously provided over a front end portion, an upper end portion and a rear end portion of the side wall 21 so as to form a pair together with the peripheral wall 12 of the first case 1, and a lower end portion side thereof is opened. In the present embodiment, the second case 2 is also structured as an integral molded product made of a synthetic resin. In a lower end portion side of the side wall 21, there is formed a concave portion 23 which is depressed to an inner side in correspondence to a thickness of a vertical wall 32 mentioned below of the holding portion 3 in such a manner as to form a pair together with the concave portion 13 of the first case 1. Further, an engagement hole 25 is formed at one position approximately facing accurately to the holding portion 3, that is, a opposite position, in an upper end portion of the peripheral wall 22, and the engagement hole 25 can be engaged with the engagement hole 15 of the first case 1 mentioned above. Further, as shown in FIG. 4, a shaft portion extending approximately horizontally is formed in a protruding manner in a front end portion side and a rear end portion side in an inner side surface of the side wall 21, a wind-off gear 26 is rotatably supported to the shaft portion of the front end portion side so as to rotationally drive the wind-off spool 16 by a wind-off core 26*a* attached to the wind-off gear 26 (FIG. 4A), and a take-up gear 27 integrally having a take-up core 27*a* for rotationally driving the take-up spool 16 is rotatably supported to the shaft portion of the rear end portion side (FIG. 4B).

Further, a rotating shaft 28 rotatably supporting the holding portion 3 is formed in a protruding manner at a position which is slightly rear side from the lower end portion of the wind-off gear 26 in a lower end portion side of the side wall 21, that is, in a space between the wind-off gear 26 and the take-up gear 27.

Figure 3:
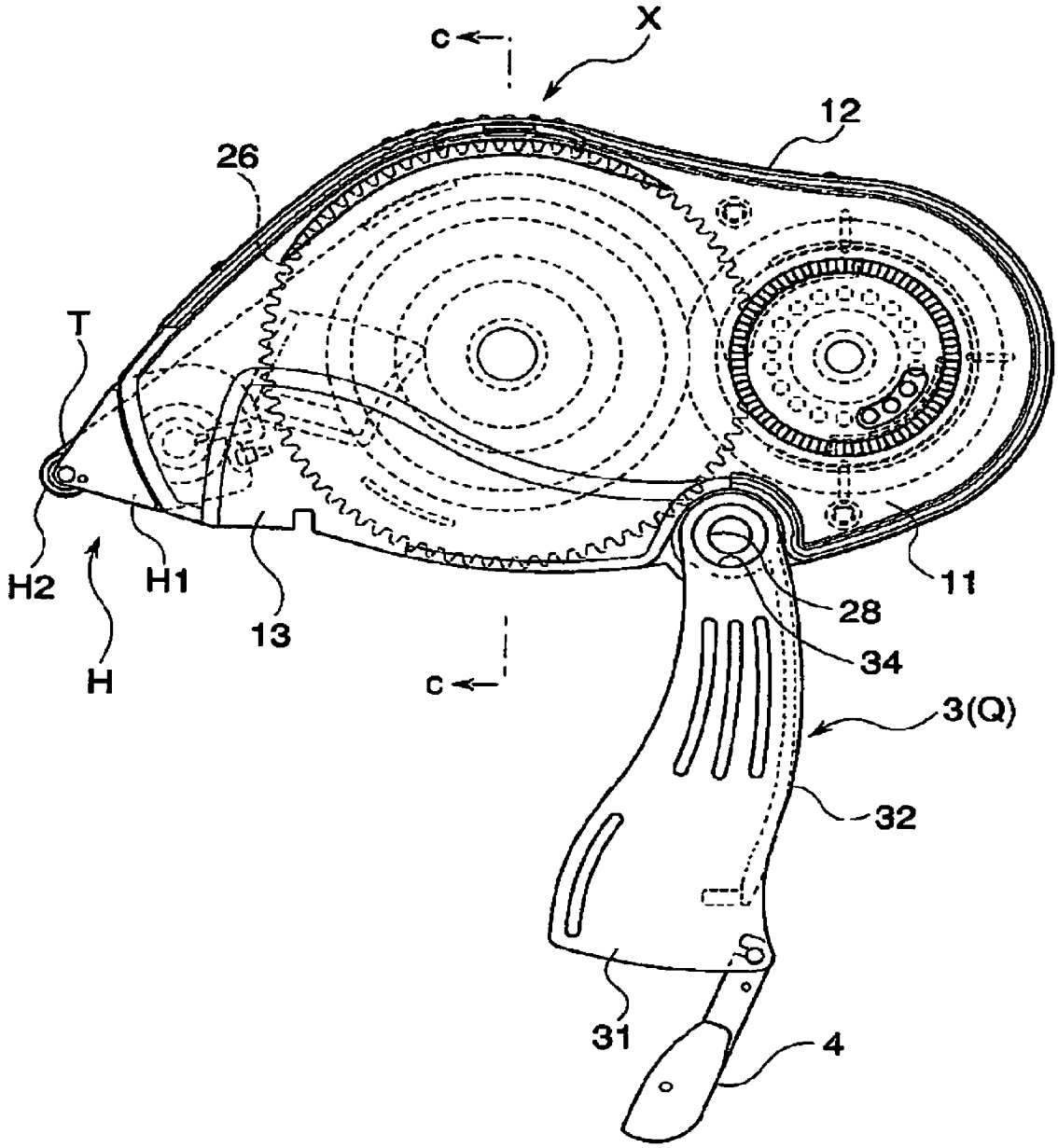
FIG. 3 is a plan view showing a hold canceled state of the transfer tool.

The holding portion 3 combines a function of holding the first case 1 and the second case 2 in a state in which they are fitted to each other so as to set the transfer tool A to a used state (P) shown in FIG. 2 in which the transfer tool A can be used, and a function of setting the first case 1 and the second case 2 to a hold cancel state (Q) shown in FIG. 3 in which the first case 1 and the second case 2 can be divided.

Specifically, the holding portion 3 is rotatably attached to the rotating shaft 28 protruded to the second case 2 via a bearing 34, and is formed as a C-shaped cross sectional shape mainly constituted by right and left plate-shaped vertical walls 31 and 32, and a plate-shaped bottom wall 33 connecting lower sides of the vertical walls 31 and 32, as shown in FIG. 4A. In the present embodiment, the vertical walls 31 and 32 and the bottom wall 33 are formed as an integral molded product made of a synthetic resin, and employ a structure which has a larger thickness and a higher rigidity than the first case 1 and the second case 2. The right vertical wall 31 and the left vertical wall 32 are outside fitted to the concave portions 13 and 23 of the first case 1 and the second case 2 in the used state (P), and are structured such that the bottom wall 33 covers the open lower end portions of the first case 1 and the second case 2. At this time, the vertical walls 31 and 32 are respectively structured such as to be approximately flush with the side walls 11 and 21 of the first case 1 and the second case 2.

Further, a cap 4 is rotatably attached to a leading end of the holding portion 3, and the structure is made such that it is possible to establish a coating attitude (C) shown by a solid line in FIG. 2 and coating the transfer head H mentioned above and an exposing attitude (O) shown by a broken line in FIG. 1 or 2 and exposing the transfer head H, by rotating the cap 4.

Accordingly, the transfer tool A in accordance with the present embodiment forms the engagement portion X in accordance with the present invention by the engagement projection 15 of the engagement hook 14 formed in the first case 1 and the engagement hole 25 formed in the second case 2 as mentioned above, in the direction opposite to the holding portion 3. Further, in the case of replacing the first case 1 corresponding to the replacement part, the structure is made such that the first case 1 can be detached from the second case 2 by rotating around the engagement portion X, as shown in FIGS. 5A, 5B and 5C.

A description will be given below of a series of operations for detaching the first case from the second case, in the transfer tool A in accordance with the present embodiment, with reference to FIGS. 5A, 5B and 5C. First, FIG. 5A is a cross sectional view along a line c-c in FIG. 3, that is, in the case that the holding portion 3 is set to the hold cancel state (Q). Further, when rotating the first case around the engagement portion X from the state shown in FIG. 5A, the state is changed to the state in FIG. 5C via the process shown in FIG. 5B, whereby the first case 1 is detached.

In this case, a taper surface 16*a* preventing an interference with the wind-off core 26*a* at a time of executing a replacing work of the first case 1 is formed in an inner surface of the wind-off spool 16 engaging with the wind-off core 26*a* in the wind-off gear 26 side. Accordingly, it is possible to preferably change the state to the state in FIG. 5C from the process shown in FIG. 5B so as to preferably detach the first case 1, without being specifically interfered with the wind-off core 26*a*. On the other hand, when installing the new first case 1 to the second case 2 side, the reverse operations to those mentioned above are executed. Further, in addition, since the engagement hook 14 formed in the first case 1 is structured such as to be elastically deformable in a thickness direction, it is possible to approximately simultaneously fit the engagement projection 15 and the engagement hole 25, that is, the engagement portion X, the wind-off spool 16 and the wind-off core 26, and the take-up spool and the take-up core 27 respectively while opposite the first case 1 and the second case 2 to each other in parallel in a cross sectional view. At this time, since the engagement hook 14 is elastically deformed, the engagement projection 15 is fitted to the engagement hole 25 via the state of being evacuated in the thickness direction corresponding to the vertical direction in the drawing temporarily at a time when the engagement projection 15 is brought into contact with the peripheral wall 22. As mentioned above, the transfer tool A in accordance with the present embodiment is structured such that the first case 1 corresponding to the replacement part can be easily replaced by rotating the first case 1 around the engagement portion 3 while setting the holding portion 3 to the hold cancel state (Q). Further, describing in detail, since the taper surface 26*a*1 is provided in the wind-off core 26*a* in the present embodiment, it is possible to better detach the first case 1 while avoiding the interference between the taper surface 16*a* of the wind-off spool 16 and the taper surface 26*a*1 of the wind-off core 26*a*.

As mentioned above, since the transfer tool A in accordance with the present embodiment is provided with the holding portion 3 which can hole the first case 1 and the second case 2 by being detachably outside fitted to the predetermined region of the first case 1 and the second case 2, and the engagement portion X detachably engaging the first case 1 and the second case 2 in the opposite direction of the holding portion 3, the holding portion 3 securely holds the first case 1 and the second case 2 in the predetermined region, that is, in one side corresponding to the opposite direction of the engagement portion X, thereby securely holding the shape of the transfer tool A itself and preferably improving the transferring performance of the tape glue T corresponding to the transferring object and the using feeling of the transfer tool A. Further, the strength of the transfer tool A is preferably improved.

Further, specifically, since the engagement portion X is provided at the approximately facing accurately to the holding portion 3, it is possible to more securely combine the strength of the transfer tool A itself and the shape keeping. In detail, since the engagement portion x is provided at only one position opposite to the holding portion, it is possible to achieve the engagement portion X by the simple structure, that is, it is possible to preferably maintain the shape together with the holding portion 3.

Figure 5:
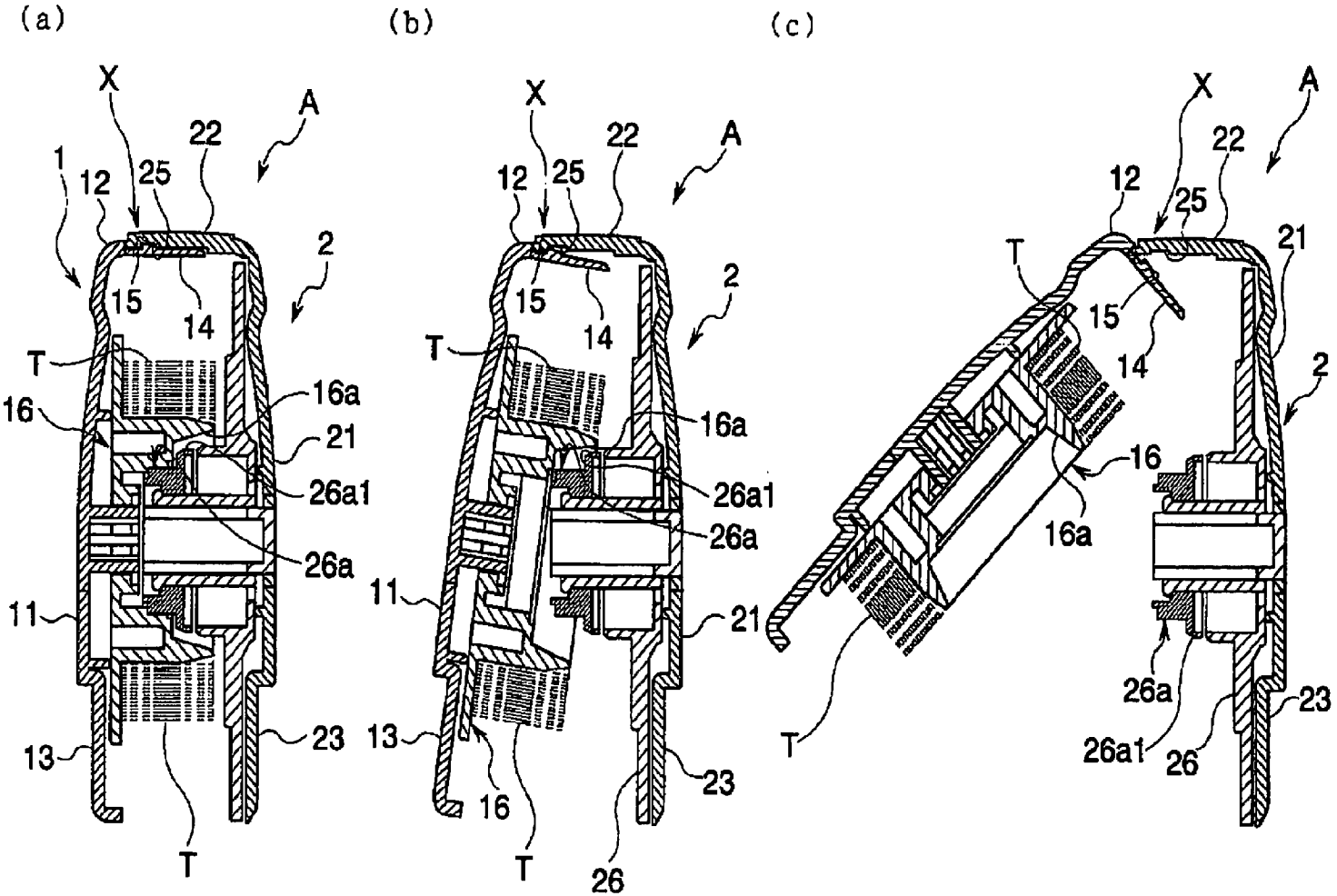
FIG. 5A to 5C are explanatory views of an operation in accordance with the embodiment.

Further, when replacing the first case 1 corresponding to the replacement part, the structure is made such that the replacing work can be easily executed by setting the holding portion 3 to the hold cancel state (Q), and relatively rotating the first case 1 and the second case 2 around the engagement portion X in the hold cancel state (Q), whereby it is possible to move the first case 1 and the second case 2 close to and apart from each other in addition, it is possible to preferably avoid the interference between the wind-off spool 16 corresponding to the replacement part and the wind-off core 26*a* corresponding to the non-replacement part, by arranging the taper surface 16*a* as shown in FIG. 5 in the wind-off spool 16 attached to the first case 1, and it is possible to smoothly cancel the engagement between the first case 1 and the second case 2 so as to execute the replacing work of the first case 1.

In addition, since the holding portion 3 is attached to the second case 2, it is possible to effectively reduce the number of the parts attached to the first case 1 corresponding to the replacement part, and it is possible to preferably intend to reduce the running cost in accordance with the continuous use.

The description is given above of the embodiment in accordance with the present invention, however, the specific structure of each of the portions is not limited to the embodiment mentioned above. For example, the engagement portion may be provided at two or more positions opposite to the holding portion. Further, the shape of the engagement portion is not limited to the structure in which the engagement hole is engaged with the engagement projection of the engagement hook, but may be structured, for example, such that the first case is pivoted to the second case. Further, the embodiment mentioned above discloses the aspect in which the taper surface is formed in the wind-off spool and the wind-off core, however, does not exclude the aspect in which the taper surface is provided in one or both of the take-up spool and the take-up core.

In addition, the specific structure of each of the portions is not limited to the embodiment mentioned above, but can be variously modified within the scope of the present invention.

What is claimed is:

1. A transfer tool comprising:

a first case holding a replacement part including at least a transferring object;

a second case detachably engaged with the first case and holding a non-replacement part constituting at least a part of a feeding mechanism part feeding the transferring object to a transferred object, wherein the second case comprises a wind-off gear and a take-up gear, a holding portion outside fitted detachably to a predetermined region of the first case and the second case and capable of holding the first case and the second case;

a rotating shaft rotatably supporting the holding portion;

an engagement portion detachably engaging the first case and the second case in a opposite direction of the holding portion;

a cap rotateably coupled to an end of the holding portion;

wherein the first case and the second case are attached and detached by relatively rotating the first case and the second case around the engagement portion when the holding portion is detached from the predetermined region of the first case and the second case;

wherein the replacement part comprises a wind-off spool and the non-replacement part comprises a wind-off core attached to the wind-off gear, wherein the wind-off spool engages the wind-off core when the first case and second case are engaged, wherein the wind-off spool has a taper surface and the wind-off core has a taper surface, the taper surfaces facing each other, avoiding interference between the replacement part and the non-replacement part when the rotating motion is provided in any one or both of the replacement part and the non-replacement part;

wherein the rotating shaft is positioned between the wind-off gear and the take-up gear.

2. A transfer tool as claimed in claim 1, wherein the engagement portion is provided at a position approximately facing the holding portion.

3. A transfer tool as claimed in claim 1, wherein the engagement portion is provided at only one position opposite to the holding portion.

4. A transfer tool as claimed in claim 1, wherein the holding portion is pivotally attached to the second case.

5. A transfer tool as claimed in claim 2, wherein the engagement portion is provided at only one position opposite to the holding portion.

6. A transfer tool as claimed in claim 2, wherein the holding portion is pivotally attached to the second case.

7. A transfer tool as claimed in claim 3, wherein the holding portion is pivotally attached to the second case.

* * * * *